US006519821B2

(12) United States Patent
Steuer

(10) Patent No.: US 6,519,821 B2
(45) Date of Patent: Feb. 18, 2003

(54) HOT STAMPING METHOD AND HOT STAMPING DEVICE

(76) Inventor: Armin Steuer, Am Waldrand 30, 71111 Waldenbuch (DE)

( * ) Notice: Subject to any disclaimer, the term of this patent is extended or adjusted under 35 U.S.C. 154(b) by 127 days.

(21) Appl. No.: 09/853,618

(22) Filed: May 14, 2001

(65) Prior Publication Data

US 2001/0052171 A1 Dec. 20, 2001

(30) Foreign Application Priority Data

May 17, 2000 (DE) ..... 100 23 888

(51) Int. Cl.[7] ..... B30B 11/18

(52) U.S. Cl. ..... 29/17.1; 29/17.9; 29/17.1; 29/424; 72/421

(58) Field of Search ..... 29/17.1–18.1, 29/424; 72/421

(56) References Cited

U.S. PATENT DOCUMENTS

| | | | |
|---|---|---|---|
| 6,059,003 A | * | 5/2000 | Wittkopf |
| 6,230,616 B1 | | 5/2001 | Steuer |
| 6,334,248 B1 | * | 1/2002 | Gallagher |

FOREIGN PATENT DOCUMENTS

| | | | |
|---|---|---|---|
| DE | 29 31 194 | | 2/1981 |
| DE | 37 13 666 | | 11/1988 |
| DE | 39 41 424 | | 6/1991 |
| DE | 1038035 | * | 3/2000 |
| EP | 0 718 099 | | 6/1996 |
| GB | 3811 | * | 2/2000 |
| WO | WO-06368 | * | 2/2000 |

* cited by examiner

*Primary Examiner*—Gregory M. Vidovich
*Assistant Examiner*—Don Reiley
(74) *Attorney, Agent, or Firm*—Nath & Associates PLLC; Gary M. Nath

(57) ABSTRACT

In a hot stamping or embossing method for stamping single sheets or webs with stamping product located on a stamping foil web, the material to be printed is moved through the stamping gap and the stamping foil web is jointly moved in such a way that during stamping intervals it is moved at the same speed as the printing material and outside the stamping intervals, at least temporarily, it has a foil speed differing from the printing material speed. According to the invention between two selected stamping intervals the stamping foil web is briefly accelerated in such a way that a space between succeeding, stamping product-delivering stamping product areas of the stamping foil web is larger than the corresponding, unprinted area of the printing material between succeeding stamping locations, which can be utilized for economizing foil material.

12 Claims, 2 Drawing Sheets

HOT STAMPING METHOD AND HOT STAMPING DEVICE

BACKGROUND OF THE INVENTION

1. Field of the Invention

Figure 1:
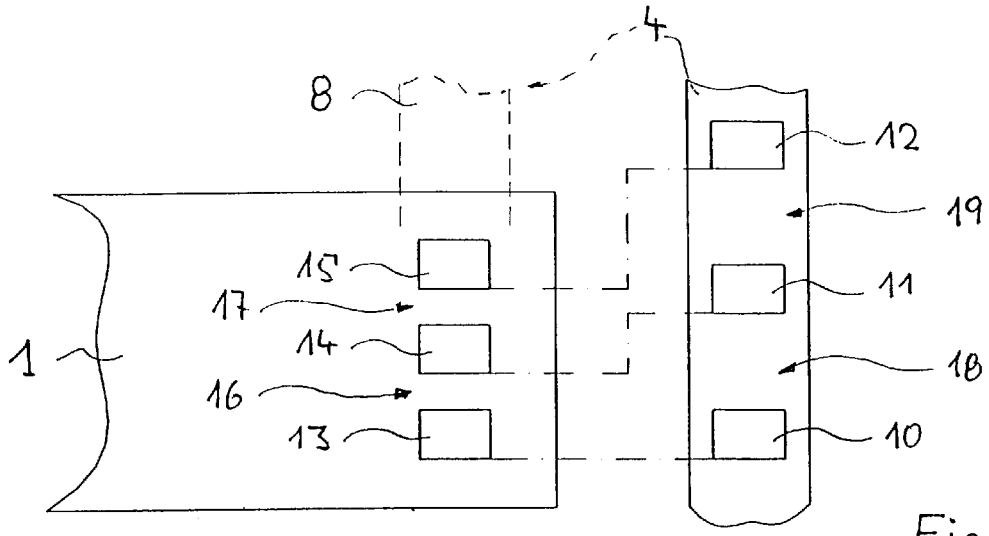

The invention relates to a hot stamping method and to a hot stamping device particularly suitable for performing the method.

2. Description of the Prior Art

Hot stamping or embossing methods and devices of this type are used for the hot stamping or embossing of material layers to be stamped with stamping product on a stamping foil web. The material layer, also referred to as printing material and which can be a sheet or a web material, is moved at a normally uniform material layer speed through a stamping gap and the stamping foil web is jointly moved in such a way that a stamping foil web portion during a stamping interval moves at the same speed as the material layer through the stamping gap. This is necessary so that the stamping product, which can be discreet, juxtaposed or successively arranged stamping units such as images, texts, etc., or parts to be stamped on or areas of ink or colour coatings, can pass in undistorted and unsmeared manner onto the material layer to be stamped and consequently the stamping foil web does not tear during the stamping interval.

In order to minimize waste of the often expensive stamping foil or film material, in the case of stamping foils the aim is to keep as small as possible the unused or unstamped foil web areas. It has already been proposed for this purpose to bring successively positioned stamping product areas to be stamped on the stamping foil web closer together than successive stamping locations on the material web. This can be brought about in that the stamping foil web outside a stamping interval is moved at least temporarily at a foil web speed differing from the material layer speed. The necessary speed changes to the stamping foil web can be obtained by foil accelerating means and a foil acceleration can be both a speed increase/decrease and a direction reversal of the stamping foil web movement.

A hot stamping rotary press providing a feed speed rise upstream of a stamping interval and a feed speed drop after a stamping interval with respect to the stamping foil is disclosed by DE 29 31 194. In this case the stamping foil web is always moved in the main movement direction thereof, the speed in said direction varying and never being higher than the material layer speed.

To reduce the accelerative forces acting on the possibly tension-sensitive stamping foil web, DE 37 13 666 already proposes to pull back by a certain amount the stamping foil web upstream of every new stamping interval, so as to permit a longer starting distance and optionally also a longer decelerating distance, so that acceleration strains on the stamping foil web can be reduced. Here again the foil web speed in the main conveying direction at no time exceeds the material layer speed.

SUMMARY OF THE INVENTION

The object of the invention is to so further develop hot stamping methods and devices of the aforementioned type that there is a particularly effective utilization of the stamping product on the stamping foil web.

For solving this problem the invention proposes a hot stamping method for stamping material layers with a stamping product present on a stamping foil web, in which a material layer is moved at a material layer speed through the stamping gap and the stamping foil web is jointly moved in such a way that a stamping foil web portion during a stamping interval is moved at the same speed as the material layer through the stamping gap whereas, outside a stamping interval, the stamping foil web portion is at least temporarily moved at a foil web speed differing from the material layer speed, wherein the following steps are provided:

stamping a first stamping product area of the stamping foil web during a first stamping interval at a first stamping location, stamping a second stamping product area, following the first stamping product area in the web direction, during a following, second stamping interval at a second stamping location, acceleration of the stamping foil web between the first and second stamping intervals in such a way that a space between succeeding stamping product areas of the stamping foil web is larger than an unstamped area between associated, succeeding stamping locations of the material layer. There is further provided hot stamping device comprising:

a stamping press, in which between a cylinder and a movable back pressure element, a stamping gap is formed at least during a stamping interval, and foil conveying means for producing, at least during a stamping interval, a speed of a stamping foil web portion with being the same as the speed of a material layer moved with a material layer speed through the stamping gap, the foil conveying means being constructed as foil acceleration means in such a way that the stamping foil web portion, outside the stamping intervals, at least temporarily is movable with a foil web speed differing from the material layer speed;

wherein the stamping foil web can be accelerated by the foil accelerating means between a first stamping interval and a following, second stamping interval in such a way that a space provided with the stamping product between succeeding stamping product areas of the stamping foil web delivering stamping product is larger than an unstamped area between associated, succeeding, stamping product-receiving stamping locations on the material layer and which is particularly suitable for performing this method. Preferred further developments are given in the dependent claims. By reference the wording of all the claims is made into part of the content of the description.

A hot stamping method according to the invention is characterized in that at least once during a stamping pass during a first stamping interval a first stamping product area of the stamping foil web is stamped at a first stamping location of a material layer, that during an immediately following, second stamping interval on a second stamping location of a material layer is stamped a second stamping product area of the stamping foil web following the first stamping product area in the web direction and that between these stamping intervals the stamping foil web is accelerated in such a way that between the successive stamping product areas of the stamping foil web is formed a gap or space still provided with the stamping product and which, measured in the web direction, is larger than an unstamped area between the succeeding stamping locations on the material layer. For this purpose and diverging from all known solutions, the stamping foil web in the acceleration phase between the succeeding stamping intervals is moved at least temporarily in the main movement direction of the stamping foil web at a web speed which is higher than the normally uniform material layer speed. The web speed can e.g. be more than 5, 10 or 20% higher than the material layer speed, but is in general less than 50% higher. In the acceleration phase there is at least one deceleration or speed reduction of the stamping foil web to ensure that the latter in the stamping interval following the acceleration phase moves at the same speed as the material layer. The speed rise and speed drop are matched to one another in such a way that in the acceleration period between the stamping intervals a stamping foil web portion is moved through the stamping gap whose length exceeds the length of the material layer portion passing at the same time through the stamping gap.

As a result of this apparently contradictory measure with respect to the sought minimizing of foil web waste, it is possible to ensure that the space between the directly succeeding, already stamped stamping product areas is increased compared with the spacing of the associated stamping locations to such an extent that in a time-succeeding stamping step it is still possible to stamp stamping product from this enlarged intermediate area. A gap between succeeding stamping product areas, which is e.g. too small to enable to make economies according to the above-described, conventional methods, can also be deliberately stretched or lengthened somewhat in order to utilize the increased gap for at least one further stamping operation. The foil consumption is consequently initially deliberately locally increased and then subsequently, whilst utilizing the stamping product in the gap, to bring about overall a very effective surface utilization of the stamping product present on the stamping foil web.

The following utilization of the stamping product located in the area of the gap resulting by a deliberate size increase between the successive stamping product areas, can take place in a separate pass of the stamping foil web, optionally after winding back said stamping foil web onto a wind-off reel. However, preferably the stamping product present in the gaps is stamped in the same stamping foil pass as the stamping product in the stamping product areas bounding the gaps in the web direction. For this purpose in a preferred further development of the method there is a limited drawing back movement of the stamping foil web counter to the main movement direction following a second stamping interval and a subsequent acceleration of the stamping foil web in the main movement direction in such a way that in a third stamping interval following the second stamping interval stamping product can be transferred from the gap to the material layer. Thus, after the drawing back movement, the stretched gap area passes at least a second time through the stamping gap and during said second pass the stamping foil web is so longitudinally displaced in the web direction compared with the first pass that stamping product present in the gap can be transferred by a stamping die to the material layer.

To the extent that the printing material is in the form of successive, individual sheets, it is appropriate to coordinate the time of the drawing back movement with the passage of the sheets in such a way that said movement at least temporarily takes place during the transition between successive individual sheets through the stamping gap. Since normally between directly succeeding individual sheets a certain spacing occurs, necessarily between succeeding sheets there is a stamping pause, which is at least as long as the time elapsing between the passage of the rear edge of a leading sheet and the passage of the front edge of a directly following sheet through the stamping gap. Thus, generally more time is available for the necessary acceleration movements, so that only smaller acceleration levels and correspondingly smaller forces acting on the sensitive stamping foil sheet are necessary. Generally and in particular when printing material layers in web form, the drawing back movement is so appropriately matched to the material run and the spacing sequence of successive stamping locations, that the drawing back movement takes place at the same time as the passage of the largest stamping location spacing in the running direction. There is no need for a drawing back movement after each sheet which has passed through or after every particularly large stamping location spacing and instead it can take place in irregular manner.

A further development is particularly advantageous if succeeding stamping product areas have essentially the same shape and size. In this further development the acceleration of the stamping foil web is carried out in such a way that the enlarged gap is so dimensioned that from the area of the gap successively at least one stamping product area can be stamped having substantially identical dimensions to the stamping product areas bounding the gap. To avoid excessive accelerations the procedure is preferably such that precisely one stamping product area is positioned in the gap and preferably symmetrically between the bounding stamping product areas. Thus, here the gap size, i.e. the extension of the gap in the longitudinal direction, is larger or at the most the same as the running direction extension of the succeeding stamping product areas, which generally have a small mutual spacing in order to ensure edge-sharp stampings. However, it would also be possible to dimension the gap so as to be shorter than the longitudinal extension of the stamping areas bounding it. It would still be possible to stamp from said gap stamping product areas which particularly in the longitudinal direction are smaller than the stamping areas bounding the gap.

It can arise that the stamping locations on the material layer to be stamped have non-uniform, mutual spacings. Particularly for such cases it can be provided that the acceleration of the stamping foil web is performed in such a way that the spacings between succeeding, stamped, stamping product areas are substantially the same. After this rendering uniform of the spacings between stamped stamping areas between the already stamped stamping product areas of the stamping foil web there are substantially identically dimensioned gaps and for this purpose part of the gaps is enlarged and another part of the gaps is correspondingly size-reduced.

The invention also relates to a hot stamping device suitable and adapted to the performance of said hot stamping method. It has a stamping press in which between a cylinder and a movable back pressure element, particularly a back pressure cylinder, a stamping gap is formed at least during a stamping interval. It has foil conveying means for producing at least during a stamping interval an identical-speed following of a stamping foil web portion with a material layer portion moved through the stamping gap and which is normally moved with a uniform speed by suitable material layer conveying means through said gap. The foil conveying means are constructed as foil accelerating means and can consequently produce a discontinuous conveying of the stamping foil web or a non-uniform following with the material layer. The foil accelerating means are constructed in such a way that the stamping foil web between a first stamping interval and a directly following, second stamping interval can be accelerated in such a way that a space provided with a not yet stamped stamping product between succeeding stamping areas of the stamping foil web delivering the stamping product is larger than an unstamped area between succeeding stamping locations on the material layer receiving the stamping product.

As stated, the foil accelerating means are so designed and controlled that during the acceleration phase the stamping foil web at least temporarily is moved with a higher web speed in the main conveying direction than the material layer. Appropriately the foil accelerating means for producing a forward/return step operation are designed so as to be able to perform the aforementioned stamping foil web drawing back movements. Although a purely electronic control of the foil accelerating means is possible, it is appropriate for controlling the latter to provide a computer unit, so that with the aid of the foil accelerating means and corresponding computer unit operating programs preset speed profiles are produced for the stamping foil web.

With respect to the construction of the stamping press and the foil conveying means the hot stamping device can e.g. be constructed in the same way as the stamping rotary press described in EP 718 099. Correspondingly the foil conveying means for an individual foil web can have a pulling device following the stamping gap and e.g. operating with a suction belt with a slip drive for the stamping foil web and a controllable foil feed device upstream of the stamping gap and cooperating with the pulling device. The foil feed device can have at least one control roller in rolling contact with the stamping foil web and controllable by a control mechanism with respect to the rotational speed and/or rotation direction and which can also be constructed as a suction roller and allows no slip in the stamping foil web direction, so that through the foil feed device it is possible to fix the precise position and speed of the stamping foil web in the or counter to the conveying direction. As a result of the e.g. computer-assisted control of the control roller, it is possible to implement inventive foil speed profiles.

These and further features can be gathered from the claims, description and drawings and the individual features, either singly or in the form of subcombinations, can be implemented in an embodiment of the invention and in other fields and can represent advantageous constructions.

Embodiments of the invention are described hereinafter relative to the attached drawings, wherein show:

FIG. 1 A diagrammatic plan view of two succeeding individual sheets in the material running direction together with a diagrammatic representation of the stamping foil web used for stamping the individual sheets following the stamping of the first and second sheets.

Figure 2:
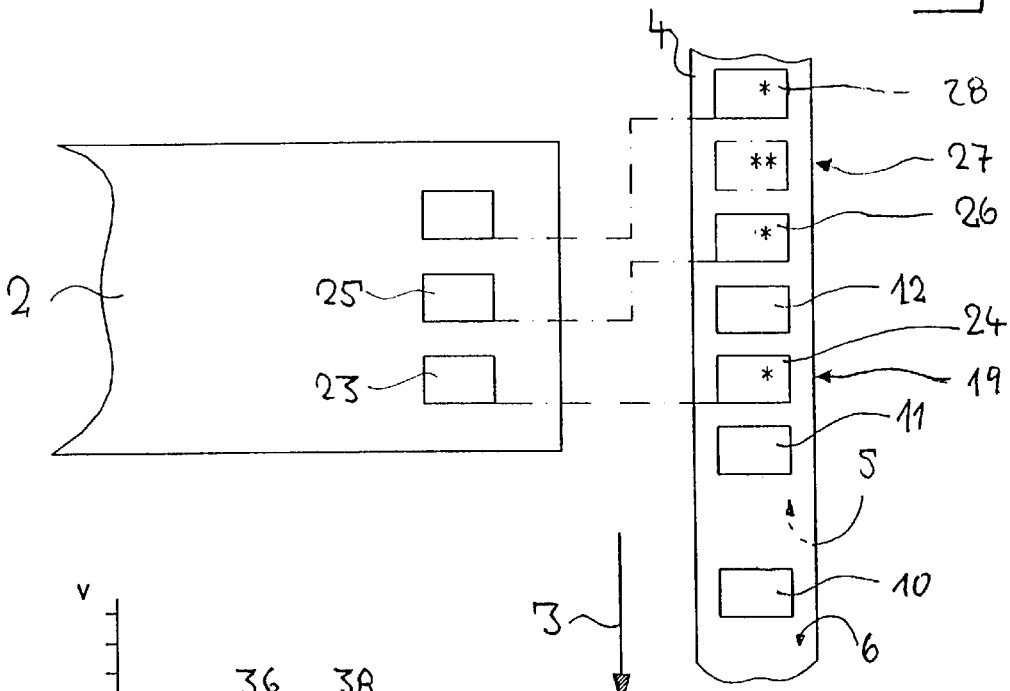
Figure 2:
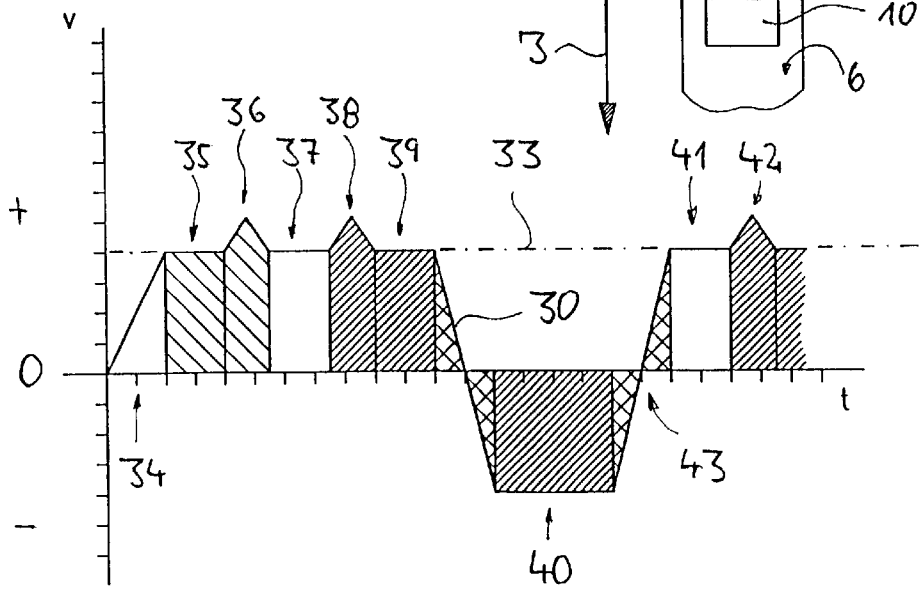

FIG. 2 A diagrammatic speed profile of the stamping foil web on stamping the first and second sheets in FIG. 1.

Figure 3:
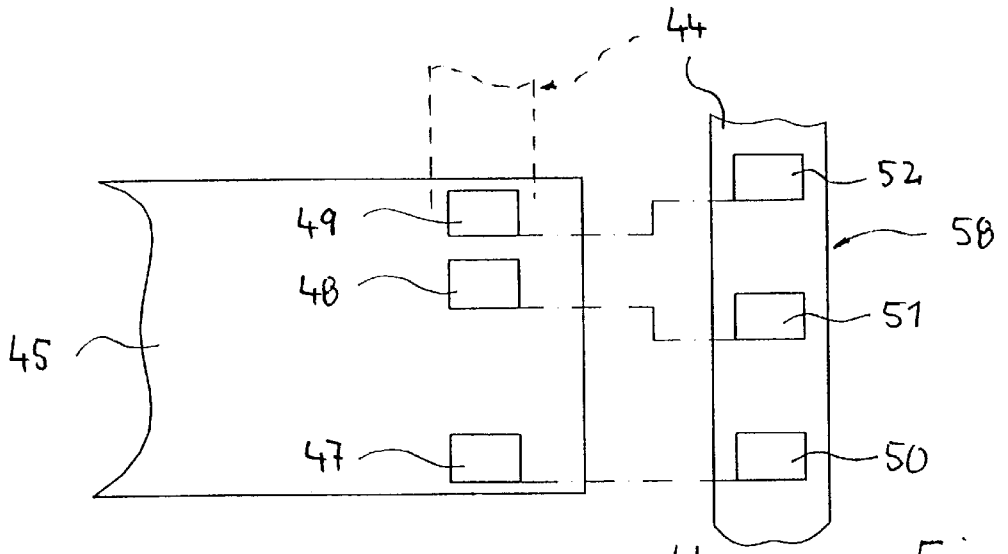

FIG. 3 A diagrammatic plan view of two succeeding individual sheets in the material running direction together with a diagrammatic representation of the stamping foil web used for stamping the individual sheets after stamping the first and second sheets during asymmetrical sheet stamping.

Figure 4:
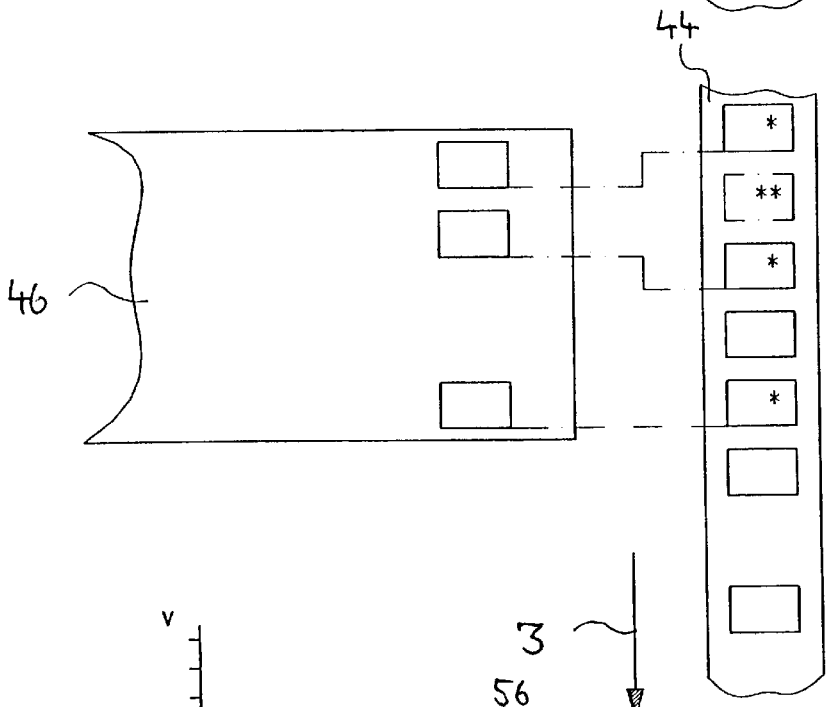
Figure 4:
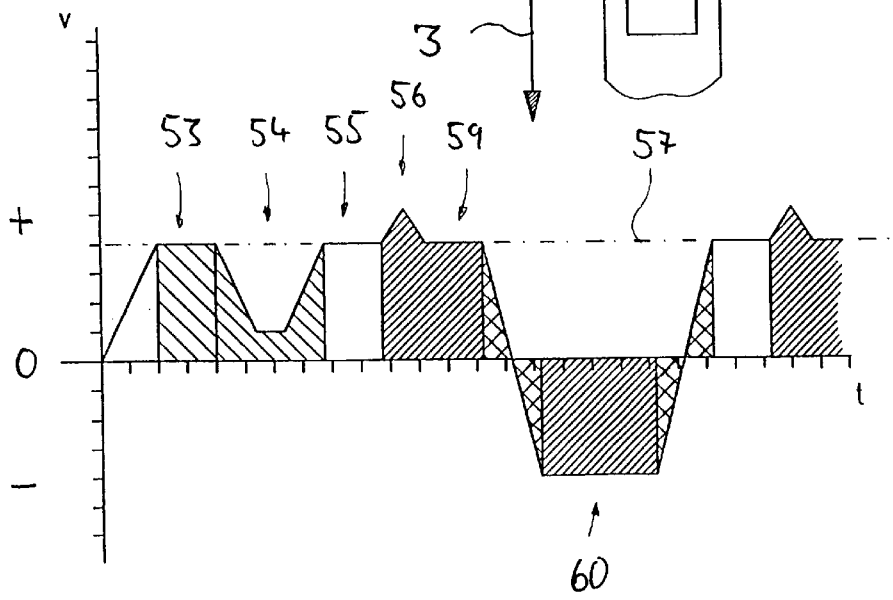

FIG. 4 A diagrammatic speed profile of the stamping foil web on stamping the first and second sheets in FIG. 3.

To the left of the diagrammatic representation of FIG. 1 can be seen two spaced, succeeding paper sheets 1, 2 conveyed through a not shown stamping gap of a hot stamping or embossing device and which are conveyed by means of not shown material layer conveying means at a uniform material layer speed in a running direction 3 through said gap. The upper part of the drawing shows the situation following the passage of the first sheet 1 through the stamping gap, whilst the lower part thereof shows the situation after the passage of sheet 2 at a correspondingly later time. In each case to the right alongside the sheets 1, 2 is shown a portion of a stamping foil web 4, which is conveyed with the aid of a not shown foil conveying means through said stamping gap. The stamping foil web, which for representational reasons is shown alongside the sheets 1, 2, in actual fact passes above the area traversed by sheets 1, 2 and the invisible front side 5 of the stamping foil sheet shown from the viewing direction of its reverse side 6, faces the surfaces to be stamped of the sheet-like material layers 1, 2. The actual sheet foil direction 8 above the sheets 1, 2 is shown in broken line form. Several, parallel stamping foil webs can be provided for stamping a material layer.

A stamping foil generally has a thin, multilayer, dry film, which is placed on a tear-proof foil carrier, e.g. of plastic. On its front 5 the film carries the stamping product, which can e.g. be an ink or colour coating. The layer structure of the film is generally such that on the front of the foil carrier is located an e.g. wax-like separating layer on which is located a colour-determining or image-determining single or multiple layer incorporating the stamping product. On the latter is located a thermally activatable hot-melt adhesive or adhesive layer.

During stamping the material 1, 2 to be stamped is uniformly moved through the stamping gap. The stamping foil web is jointly moved in such a way that the shown stamping foil portion at least during a stamping interval is moved at the same speed as the sheets through the stamping gap. During a stamping interval the stamping foil web portion is pressed onto the material layer portion to be stamped with a not shown stamping cylinder located above the paper plane and provided on its circumference with at least one heated stamping die or tool. The hot-melt adhesive layer located on the front 5 of the stamping foil facing the material layer is heated to a stamping temperature and softens under the influence of the stamping die pressed on and heated to typical surface temperatures of more than 200° C. In conjunction with the pressure briefly applied during the stamping interval there is a good, flat-adhering adhesive connection between the printed material and the stamped stamping product. Simultaneously as a result of the heat action the separating layer softens or evaporates, so that an easy detachment of the stamping product from the foil is obtained.

The upper part of FIG. 1 shows a situation arising if on the individual sheet 3 in three stamping intervals succeeding with the same time period three e.g. rectangular stamping product areas or ink coating areas 10, 11, 12 uniformly spaced on the stamping foil web are stamped in time-succeeding manner on three stamping locations 13, 14, 15 of the single sheet 1 in spaced succeeding manner in the running direction 3. It can be seen that the length of the unstamped areas 16, 17 measured in the running direction 3 between the flat-extended, rectangular stamping locations 13 to 15 is much smaller than the corresponding length, measured in the web or running direction 3 of the stamping foil web of the gaps or spaces 18, 19 between the already stamped stamping areas 10, 11, 12 still provided with stampable ink coating. It can also be seen that the spacings between succeeding, stamped rectangular areas 13 to 15 on the single sheet 1 are smaller than the length of the rectangular, stamped areas measured in the running direction 3, whilst the corresponding gaps 18, 19 between already stamped stamping product areas 10 to 12 in the web direction are larger than the longitudinal extension of the corresponding stamping areas. The latter makes it possible for the stamping product still present in the vicinity of the gaps or spaces 18, 19 in at least one time-succeeding, following pass of the stamping foil web 4 through the stamping gap to be stamped with stamping dies of the same size as during the first pass.

The corresponding situation after stamping a stamping pattern corresponding to that of sheet 1 on the time-succeeding sheet 2 is shown in the lower part of FIG. 1. The ink coating areas stamped during this pass are marked by an asterisk on the stamping foil web and have the same mutual spacings as the stamping areas 10, 11, 12 of the first pass and are longitudinally displaced with respect thereto by a displacement distance, whose length is 1<< times the centre to centre distance of succeeding stamping product areas. It can be seen that a front stamping location 23 of sheet 2 corresponding to the front stamping location 13 of sheet 1 has been stamped with stamping product 24 emanating from the space 19 between the stamping product areas 11 and 12 stamped during the first pass (upper part of FIG. 1). Correspondingly, e.g. on the central stamping location 25 corresponding to the central stamping location 14 of sheet 1, stamping product 26 is stamped which comes from a space 27, which in the web direction follows onto the rear or third stamping product area 12 of the first pass (upper part of FIG. 1). Following a further drawing back movement of the foil web, from the enlarged space 27 between the rear stamping product areas 26, 28 of the second pass, in a succeeding pass a further stamping product area of the same size and marked by two asterisks can be stamped.

On the basis of the lower part of FIG. 1 it is clear that following the second and third passes of the stamping foil web 3 through the stamping gap most printed stamping product areas are more closely juxtaposed than the stamping locations on the single sheets 1, 2. As a result of the described "pilgrim step method" there is consequently on the stamping foil web 4 a better surface utilization of the expensive ink coating than would be possible if for printing of in each case three succeeding stamping locations of a single sheet, the stamping foil web was moved at the material speed through the stamping gap.

This particularly good foil utilization is made possible by a particularly appropriate control of the speed and movement direction of the stamping foil web through the stamping gap, which is illustrated by FIG. 2. FIG. 2 shows a speed profile 30 of the stamping foil web 4 in a coordinate system, in which on the X-axis is plotted the time t and on the Y-axis the speed v of the stamping foil web. The dot-dash line parallel to the X-axis represents the constant material layer speed 33 with which the individual sheets 1, 2 successively pass through the stamping gap. The surface areas of the hatched regions below the speed curve 30 in each case represent path distances of the foil web movement in the running direction (positive speed values) and counter to the running direction (negative speed values).

The initially stationary stamping foil web is so accelerated in a first speed rise phase 34 that its web speed corresponds to the material layer speed 33. Then in a first stamping interval 35, where the sheet 1 and stamping foil web 4 pass at the same speed through the stamping gap, the first stamping product areas 10 in the running direction 3 are stamped on stamping location 13 of sheet 1. In the following acceleration phase 36 the stamping foil web speed in the main movement direction 3 is initially linearly increased by e.g. 25% beyond the material layer speed 33 and is then subsequently linear decelerated to the material layer speed. Thus, during the acceleration phase 36 more foil web length passes through the stamping gap than sheet material to be printed. In the second stamping interval 37 following the acceleration phase 36 the stamping product from the second stamping product area 11 is transferred from the stamping foil web to the central stamping location 14 of the first sheet 1. Since in the acceleration phase 36 more foil web length passes through the stamping gap than sheet material, the stamped stamping foil areas 10, 11 in the longitudinal direction 3 are further apart than the corresponding stamping locations 13, 14 on the sheet material. The second stamping interval is followed by a further acceleration phase 38 with a speed rise and fall until finally in the third stamping interval 39 the stamping product present in the stamping product area 12 is stamped at the stamping location 15 of sheet 1.

Shortly after the end of the third stamping interval sheet 1 has passed through the stamping gap and the spaced-following sheet 2 approaches the stamping gap. During this period when considerable time elapses up to the passage of the next stamping location through the stamping gap, the stamping foil web is decelerated to zero and is drawn back counter to the main movement direction 3 through the stamping gap so that part of the stamping foil web portion shown at the top of FIG. 1 is upstream of the stamping gap in the main movement direction. The maximum drawing back speed produced during the drawing back phase 40 and whose amount e.g. corresponds to the oppositely directed material layer speed, as well as the duration of the drawing back phase are controlled e.g. in such a way that the resulting drawing back movement (corresponding to the surface area under the negative part of the speed profile 30) is sufficient, so that following a further speed rise of the stamping foil web in the main conveying direction, said web during a fourth stamping interval 41 passes through the stamping gap in such a way that stamping product 24 from the enlarged space between the already stamped areas 11, 12 at the stamping location 23 can be transferred to the second sheet 2. So as to ensure that at the following stamping location 25 stamping product 26 can be transferred from the following foil portion to the sheet 2, the fourth stamping interval 41 is followed by a further acceleration phase 42, where the speed control of the stamping foil web precisely corresponds to that of the first acceleration phase 36.

The length displacement of the stamping foil web 4 which in the example shown passes several times through the stamping gap and obtained through the limited drawing back movement during the drawing back phase 40 is consequently dimensioned in such a way that the stamping processes always take place in staggered manner compared with the stamping processes in the preceding stamping pass. In the example shown the surface area content of the single hatched area under the constant speed curve 30 in the drawing back phase 40 precisely corresponds to the surface area content hatched in the same way below curve 30 in the acceleration phase 38 and the following, third stamping interval 39. The intermediate, cross-hatched triangular areas of the deceleration and reacceleration phase rise against one another. This means that longitudinal position of the foil web with respect to the stamping gap at the end of the phase of constant drawing back speed is the same as at the start of the acceleration phase 38. During the following deceleration of the drawing back movement and acceleration in the running direction up to the material layer speed 33 (cross-hatched triangular areas 43), the stamping foil web moves more slowly than the printing material, so that the latter is in advance of the stamping foil web and said length displacement of said web with respect to the first pass arises and allows a stamping of ink or colour from an enlarged space. In place of a regular drawing back, e.g. in each case following the passage of a sheet, an irregular foil conveying is also possible and then e.g. a repeat only takes place two sheets later. As shown in the example, it is also possible in the case of two gaps enlarged during a sheet pass to close or print only one in the directly following pass and the other in the pass following the latter.

With the aid of the inventive foil acceleration, in which the stamping foil web, e.g. in the acceleration phases 36, 38 and 42 in the main conveying direction 3, passes more rapidly through the stamping gap than the material to be stamped, it is possible to ensure that on the stamping web foil the gaps between succeeding, stamped areas can be enlarged in such a way that in a further, e.g. directly following foil pass material from the enlarged space can be stamped.

FIGS. 3 and 4 illustrate another variant of the method, in which on succeeding single sheets 45, 46 an asymmetrical stamping takes place, in which the spacings of succeeding stamping locations vary. In the example the spacing between the first stamping location 47 and second stamping location 48 is much larger than the spacing between the second and the third stamping location 49. Here the method is utilized for rendering uniform the spacings of the associated spacing product areas 50, 51, 52 in such a way that between these already stamped stamping product areas there remains sufficient unused space to ensure that in a following stamping foil web pass stamping product of the same size can be stamped from the spaces. Unlike in the variant of FIGS. 1 and 2, following the first stamping interval 53 in which stamping product from area 50 is stamped on stamping location 47, the stamping foil web 44 is so decelerated in a delay phase 54 that it remains behind the traversing individual sheet 45, so that the directly succeeding, stamped stamping product areas 50, 51 come closer together on the stamping foil web than the associated stamping locations 47, 48 on sheet 45. In a following acceleration phase 56 the stamping foil web is so accelerated over and beyond the material layer speed 57 that the gap 58 on the stamping foil web between the second stamping product area 51 and the following stamping product area 52 stamped during the following, third stamping interval 59 is larger than the spacing measured on the material layer between the associated stamping locations 48 and 49. Thus, the acceleration 56 in conjunction with the delay 54 leads to a centring of the central stamping product area 51 between the stamping product areas 50, 52 surrounding it in such a way that following a corresponding drawing back phase 60 on a further pass of the stamping foil web through the stamping gap under the control of the same speed profile the stamping product present in the spaces 58 can still be stamped.

The method explained in exemplified manner relative to the drawings can be performed with any suitable hot stamping or embossing device, whose foil conveying means are designed as foil acceleration means for a discontinuous foil web conveying and whose control allows a foil web guidance with speed profiles, which in particular permit the stamping foil web speed increase necessary during the acceleration phases to beyond the material layer speed. A constructionally suitable hot stamping rotary device is e.g. disclosed by EP 718 099, whose features are by reference made into content of the present description. It can also be a flat-round machine or press, in which the stamping gap is bounded by a stamping cylinder and a flat, oscillating-drivable back pressure element instead of by two cylinders.

Whereas in the examples described the stamping product is in the form of ink or colour areas of an ink or colour coating of the stamping foil web, the stamping product can also be in the form of discreet, juxtaposed or succeeding stamping units such as images, texts, etc. As a result of the invention, said stamping units can be if necessary placed much closer together on the stamping foil web than the corresponding stamping locations on the printing material. The method is also suitable for all printing material types, i.e. not only for the single sheets described in the examples, but also for printing material webs conveyed continuously through the stamping gap.

What is claimed is:

1. Hot stamping method for stamping material layers with a stamping product present on a stamping foil web, in which a material layer is moved at a material layer speed through a stamping gap and the stamping foil web is jointly moved in such a way that a stamping foil web portion during a stamping interval is moved at the same speed as the material layer through the stamping gap whereas, outside a stamping interval, the stamping foil web portion is at least temporarily moved at a foil web speed differing from the material layer speed, the method comprising the following steps:

stamping a first stamping product area of the stamping foil web during a first stamping interval at a first stamping location;

stamping a second stamping product area, following the first stamping product area in the web direction, during a following, second stamping interval at a second stamping location;

acceleration of the stamping foil web between the first and second stamping intervals in such a way that a space between succeeding stamping product areas of the stamping foil web is larger than an unstamped area between associated, succeeding stamping locations of the material layer.

2. Hot stamping method according to claim 1, wherein during the acceleration the stamping foil portion is moved temporarily more rapidly than the material layer in a stamping foil web main movement direction.

3. Hot stamping method according to claim 1, wherein there is performed a limited drawing back movement of the stamping foil web counter to a main movement direction following a second stamping interval and a subsequent acceleration of the stamping foil web in the main movement direction in such a way that in a third stamping interval, following onto the second stamping interval, stamping product can be transferred from the space to a material layer.

4. Hot stamping method according to claim 3, wherein the material layer is in the form of succeeding single sheets and the drawing back movement takes place at least temporarily during a passage between directly succeeding single sheets through the stamping gap.

5. Hot stamping method according to claim 1, wherein the acceleration of the stamping foil web is performed in such a way that a space between succeding stamping product areas enlarged as a result of the acceleration is so dimensioned that subsequently at least one stamping product area can be stamped from the space, the stamping product area having the same dimensions as the stamping product areas bounded by the space.

6. Hot stamping method according to claim 1, wherein in the case of non-uniform spacings of succeeding stamping locations of the material layers, the acceleration of the stamping foil web is carried out in such a way that the spacings between succeeding, stamped stamping product areas of the stamping foil web are substantially identical.

7. Hot stamping device comprising:

a stamping press, in which between a cylinder and a movable back pressure element, a stamping gap is formed at least during a stamping interval, and foil conveying means for producing, at least during a stamping interval, a speed of a stamping foil web portion with being the same as the speed of a material layer moved with a material layer speed through the stamping gap, the foil conveying means being constructed as foil acceleration means in such a way that the stamping foil web portion, outside the stamping intervals, at least temporarily is movable with a foil web speed differing from the material layer speed;

wherein the stamping foil web can be accelerated by the foil accelerating means between a first stamping interval and a following, second stamping interval in such a way that a space provided with the stamping product between succeeding stamping product areas of the stamping foil web delivering stamping product is larger than an unstamped area between associated, succeeding, stamping product-receiving stamping locations on the material layer.

8. Hot stamping device according to claim 7, wherein the foil accelerating means are so constructed and controlled that a stamping foil portion during acceleration between a first and a second stamping interval is movable temporarily more rapidly than the material layer in the main movement direction of the stamping foil web.

9. Hot stamping device according to claim 7, wherein during acceleration, a stamping foil portion is temporarily movable faster than the material layer in the main movement direction.

10. Hot stamping device according to claim 7, wherein the foil accelerating means are constructed for producing a limited drawing back movement of the stamping foil web counter to the main movement direction thereof.

11. Hot stamping device according to claim 10, wherein the foil accelerating means are so controllable that by limited drawing back movement following a second stamping interval and a subsequent acceleration of the stamping foil web in the main movement direction, in a third stamping interval following onto the second stamping interval stamping product can be transferred from the space to the material layer.

12. Hot stamping device according to claim 7, wherein for producing a speed profile of the stamping foil web by means of the foil accelerating means, it has a computer unit for controlling the foil accelerating means.

* * * * *